United States Patent [19]

Hudson et al.

[11] 3,971,407

[45] July 27, 1976

[54] MEANS FOR LOCATING SUCTION VALVE

[75] Inventors: Eugene Hudson; Henry R. Geary, both of Tyler, Tex.

[73] Assignee: General Electric Company, Louisville, Ky.

[22] Filed: Aug. 22, 1975

[21] Appl. No.: 606,864

[52] U.S. Cl. ..... 137/516.15; 417/564; 137/516.17

[51] Int. Cl.[2] ..... F16K 15/08

[58] Field of Search ..... 137/512.15, 516.11, 137/516.13, 516.15, 516.17, 519.19, 516.21, 516.23; 417/56 A, 569

[56] References Cited

UNITED STATES PATENTS

| | | | |
|---|---|---|---|
| 1,690,836 | 11/1928 | Redfield | 137/516.19 |
| 2,462,762 | 2/1949 | Nardin | 277/11 |
| 2,728,351 | 12/1955 | Cooper | 137/516.15 |
| 2,859,767 | 11/1958 | Tschudi et al. | 137/315 |
| 3,112,064 | 11/1963 | Ayling | 137/516.11 X |
| 3,403,847 | 10/1968 | Parker | 417/564 X |
| 3,865,345 | 2/1975 | Kropiwnicki | 251/367 |

*Primary Examiner*—William R. Cline
*Attorney, Agent, or Firm*—Frank P. Giacalone; Francis H. Boos

[57] ABSTRACT

An improved valve assembly for a reciprocating compressor including a valve member having inlet openings, a valve positioned adjacent the valve member being arranged to cover the inlet openings, a valve backing surface dimensioned to allow controlled movement of the valve, and a valve positioning member located between the valve member and the backing surface. The valve positioning member includes retaining portions for receiving support sections on the valve and tabs associated with the retaining portion to prevent rotational movement of the valve relative to the valve positioning member.

2 Claims, 6 Drawing Figures

MEANS FOR LOCATING SUCTION VALVE

BACKGROUND OF THE INVENTION

1. Field of the Invention

This invention relates to a valve assembly for a reciprocating compressor employing a thin flexible ring shaped valve and a guide member for aligning the valve with the intake ports, and more particularly to the provision of a retaining portion formed on the guide member for preventing the movement of the valve relative to the guide member during the assembly of the compressor to insure alignment between the valve and intake ports in the assembled compressor. The valve includes support portions projecting beyond its outer periphery while the guide member which circumscribes the valve includes recessed areas that receive the support portions. The retaining portions are formed adjacent the recess areas and are effective in maintaining the support portions in the recess area and as a result prevent movement of the valve relative to the guide member during the assembly of the compressor.

2. Description of the Prior Art

U.S. Pat. No. 2,728,351—Cooper, assigned to the General Electric Company, assignee of the present invention, shows generally the type of reciprocating compressor valve assembly employed in the present invention in that a flexible intake valve is arranged for movement between an open position on a backing surface and a closed position over intake ports on a flat face of a valve member. The valve of the Cooper patent includes a scalloped outer peripheral edge providing a plurality of circumferentially spaced support projections which are dimensioned to prevent movement of the valve, and to maintain it concentric with the inlet ports. This arrangement of support projections on a valve is costly to produce and tends to make the valve stiffer than one having fewer support projections.

U.S. Pat. No. 3,865,345—Kropiwnicki discloses a valve of generally the configuration of the present invention wherein the valve is positioned on a guide member and arranged for movement between an open position against a backing surface and a closed position over intake ports on a flat face of a valve member. U.S. Pat. No. 3,865,345 provides a valve suitably positioned on and supported by a guide. The valve includes outwardly extending ear portions which are adapted to directly rest on a supporting surface of the guide. The guide must be machined and fabricated within close tolerances that would require expensive casting or machinery operations.

Accordingly it is an object of the present invention to provide a valve guide, fabricated or stamped from thin inexpensive sheet metal stock that effectively maintains the valve in its operating design position during the assembly operation of the compressor.

SUMMARY OF THE INVENTION

An improved intake valve assembly is provided wherein a ring shaped valve is mounted concentrically with intake ports. The valve includes a pair of diametrically arranged support projections adapted to be supported on a backing surface. A ring shaped guide member arranged on said backing surface circumscribes the valve to maintain it in alignment with the intake ports. The backing surface is conically shaped to permit the flexing of the valve from a closed position over the intake ports to an open position on the backing surface.

Retaining means are provided by the present invention to restrict movement of the valve relative to the guide member when the valve is being assembled in the compressor. The retaining means is effective in preventing movement of the valve to a position between the backing surface and the guide where it may be clamped and rendered inoperative in the final assembled compressor.

DESCRIPTION OF THE PREFERRED EMBODIMENT

Figure 1:
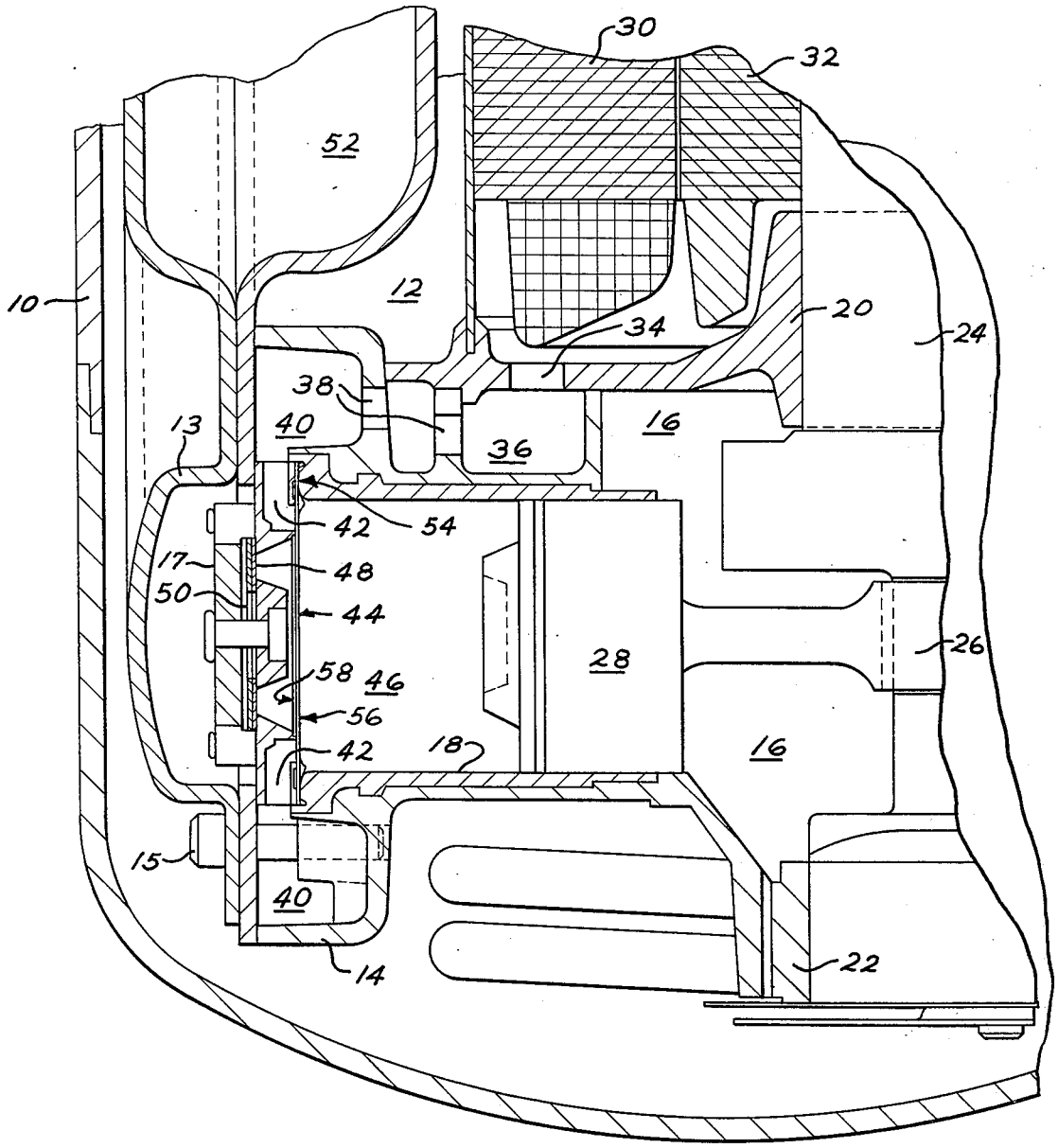
FIG. 1 is a fragmentary sectional view of a compressor showing the valve section thereof.
Figure 2:
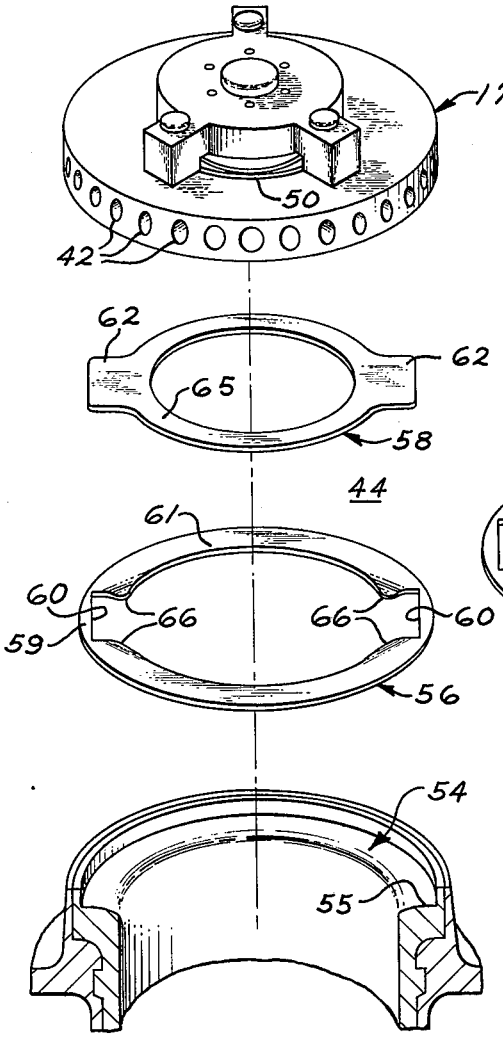
FIG. 2 is an exploded perspective view of the valve assembly incorporating the present invention.

Referring to the FIG. 1 of the drawings, there is illustrated a hermetic compressor unit comprising a shell 10 in which is resiliently supported a motor compressor unit 12. The compressor unit 12 includes a compressor block 14 and a cylinder head 13 clamped together by bolts 15 against a valve member or plate 17. The block 14 defines a substantially closed crankcase 16 and a cylinder 18 opening into the crankcase 16. The compressor block also includes upper and lower axially aligned bearings 20 and 22, respectively, in which is mounted a vertically extending shaft 24 having an eccentric bearing portion 26 between the bearing 20 and 22. Thus a piston 28 reciprocates or slides back and forth in the cylinder 18 in response to the reciprocating forces provided by the bearing portion 26. Means for driving the compressor comprises an electric motor 30 positioned in the upper portion of the shell 10 and having a rotor 32 attached to the shaft 24.

During operation of the compressor low pressure or suction gas is drawn into the case 10 and passes downwardly through the motor 30 and through a plurality of holes 34 into an annular suction muffler 36 formed in the upper portion of the compressor block 14. The suction gas flows from the muffler 36 through one or more horizontal passages 38 into an annular cavity 40 and from this cavity through a plurality of suction or inlet ports 42 arranged in the valve member 17 to provide an annular intake zone, and a suction or inlet valve assembly 44 into the interior of a chamber 46 of the cylinder 18. The compressed gas is discharged from chamber 46 through outlet or exhaust port 48 through outlet valve 50 to a discharge muffler 52 and into a discharge line (not shown) and is thereafter discharged from the compressor unit.

Figure 3:
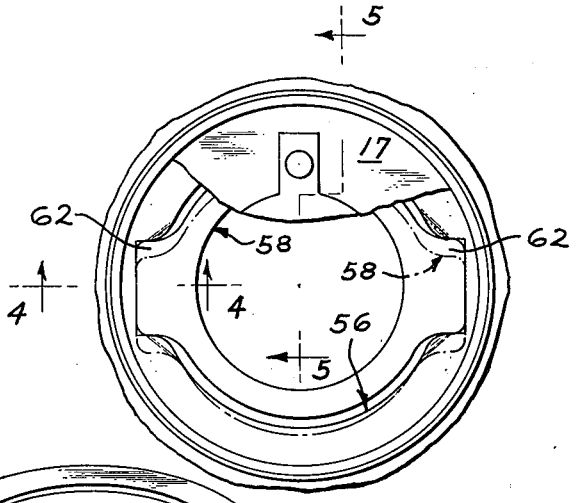
FIG. 3 is a plan view of the valve assembly with parts broken away.
Figure 4:
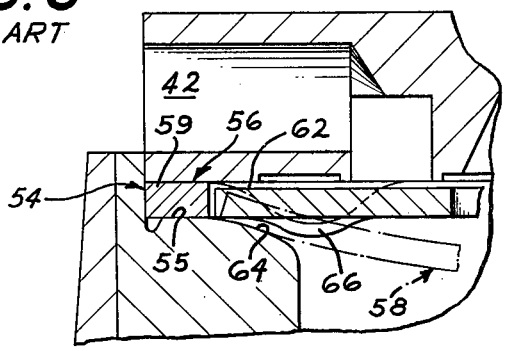
FIG. 4 is a sectional view taken substantially along lines 4—4 of FIG. 3.

The valve member 17 which carries the outlet valve 50 fits within a circular seat or recess 54 in the compressor block 14. The member 17 is spaced from the seat 54 by a ring shaped spacer or guide member 56 of the valve assembly 44. The intake port 42 is closed by a flexible ring valve 58 of the valve assembly 44; the valve 58 being constructed of suitable spring material that permits flexing thereof under pressure of incoming gas. The guide member 56 includes a continuous portion 59 adjacent its outer peripheral edge which is secured between member 17 and seat 54 and is formed to provide diametrically arranged recess areas or cutouts 60 adjacent its inner peripheral edge 61. The valve 58 is provided with support tabs 62 which as shown in FIG. 3 are arranged in the recess 60 in the assembled compressor with guide member 56 circumscribing the valve 58 with clearance therebetween. As shown in FIG. 4 in the normal or at rest position the valve 56 is supported on the bottom wall 55 of recess 54 by the support tabs 62. It should be noted that the valve 58 is of thinner material than the guide 56 and in effect provides an area for the support tabs 62 so that the valve 58 is free to move and flex rather than held or clamped between the member 17 and the block 14.

The flexing movement of the intake valve 58 away from the port 42 is limited by the bottom wall 55 of the seat 54, which is shaped in conical form inwardly from the clamped portion 59 to provide a backing wall 64 for the support tabs 62 of valve 58. Accordingly valve 58 supported by tabs 62 is therefore free to flex conically between its seated or closed position adjacent member 17 and ports 42 to an open position against the backing wall 64 as shown by dotted lines in FIG. 4. It is critical therefore to the successful operation of the compressor that the valve 56 be free to move from its closed to open position under the influence of the reciprocating piston 18 and the resulting suction gas. Referring to FIG. 3 it can be seen that the valve 56 with its support tabs 62 arranged in the recesses 60 of the guide member 58 is restricted from rotating or shifting relative thereto so that the ring portion 65 is positioned to valve the ports 42.

Figure 6:
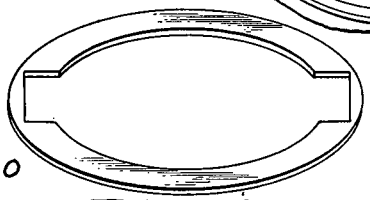
FIG. 6 PRIOR ART
FIG. 6 is a perspective view of a valve guide member in accordance with the prior art.
Figure 5:
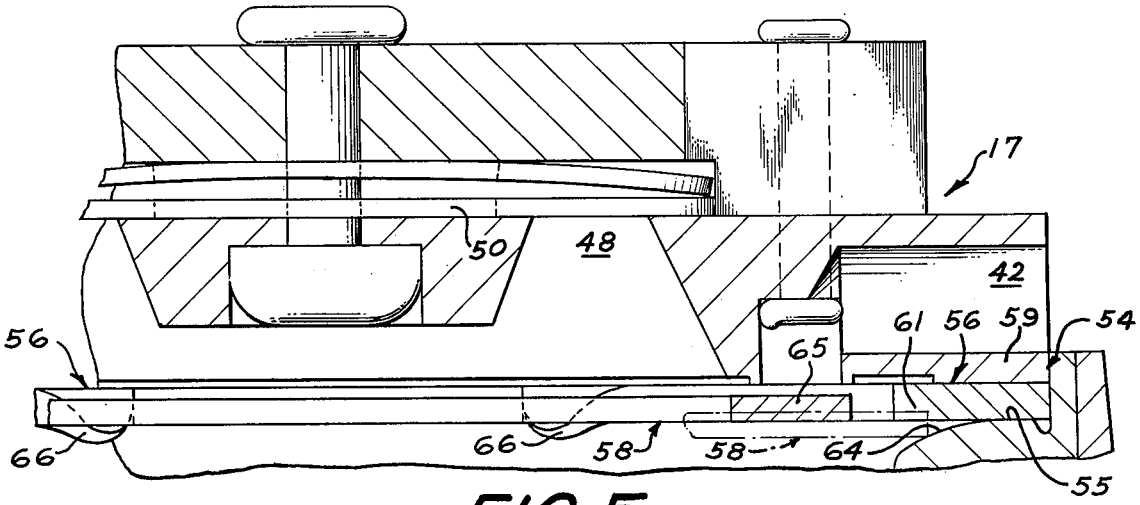
FIG. 5 is an enlarged sectional view taken substantially along lines 5—5 of FIG. 3.

The above arrangement as used prior to this invention wherein the guide member was fabricated as shown in FIG. 6 designated PRIOR ART, is effective in maintaining the valve 56 in its operative position and in preventing rotation of valve 58 relative to guide member 56, in the assembled compressor as shown in FIGS. 3, 4 and 5. However, it should be noted that during the assembly operation or when placing the valve 58 and guide 56 in the seat 54 as shown in FIG. 3, prior to securing the head 13 to the block 14, a portion of the valve 58 may be displaced or positioned inadvertently in the area between the inner portion 61 of member 56 and the sloping conical backing wall 64 as indicated by dotted lines in FIGS. 3 and 5. This movement of valve 58 relative to the guide member 56 has occurred when, as in the case of the present embodiment, the valve 58 has a thickness of between 0.014 and 0.019 inches and the guide member 56 has a thickness of between 0.023 and 0.026 inches. In the event the displaced valve 58 is not detected it may be clamped between the portion 61 of guide 56 and the bottom wall 55 of seat 54 and rendered inoperative when the head 13 is secured to the block 14.

Accordingly, holding or retaining means are provided by the present invention to effectively maintain the support tabs 62 in the respective recess 60 and as a result prevent movement of the valve 58 relative to the guide 56. The retaining means include tabs or ears 66 formed on the guide member 56 generally in the portion 61 at the junction of the inner peripheral edge and the opening defining the recess 60. The tabs may be formed by bending a segment of member 56 axially downwardly as viewed in FIG. 4 to be adjacent the backing wall 64. The tab 66 may be shaped to conform substantially to the configuration of wall 64 so as to be arranged in close enough proximity thereto to prevent valve 56 from being displaced therebetween.

The above arrangement of tabs 66 is effective in preventing the support tabs 62 from entering the area between the inner peripheral portion 61 of guide member 56 and the wall 64 and as a result the valve cannot be displaced between the guide member 56 and seat 54 where it may be inadvertently clamped when the head 13 is secured to block 14.

The foregoing is a description of the preferred embodiment of the invention and variations may be made thereto without departing from the true spirit of the invention, as defined in the appended claims.

What is claimed is:

1. In a reciprocating compressor having a cylinder block assembly including seat means and head assembly, a. a valve member between said seat means and said head assembly having a flat face and including intake means providing an annular intake zone in said flat face for passage of gas through said valve member;

b. a valve movable between an open and closed position for controlling the passage of gas through said intake means including a thin flat ring of flexible metal having a continuous portion near its inner periphery mounted concentrically with said intake zone covering said intake zone in its closed position and support portions projecting from its outer periphery supporting said valve on said seat means adjacent said flat face of said member;

c. guide means including a flat ring circumscribing said valve having a thickness greater than said valve and a continuous portion near its outer periphery arranged between said flat face and said seat means for allowing movement of said valve, and recess portions extending inwardly from its inner periphery for receiving said support portions of said valve;

d. said seat means providing a backing surface for limiting the movement of said valve in said open position;

wherein the improvement comprises:

retaining means on the inner periphery of said guide means being formed adjacent the open end of said recess portions projecting axially toward said backing surface for preventing movement of said valve relative to said guide means and from moving between said guide means and said backing surface.

2. The reciprocating compressor of claim 1, wherein, a. said backing surface includes a conical portion extending from substantially the outer peripheral edge of said valve support portions and axially away from the flat face of said valve member, and b. said retaining means being dimensioned and shaped so that they are adjacent said conical portion of said backing surface.

* * * * *